US007469503B2

(12) United States Patent
Wesson et al.

(10) Patent No.: US 7,469,503 B2
(45) Date of Patent: Dec. 30, 2008

(54) OUTSIDE GASKET FOR A VEHICLE HANDLE EXHIBITING WIND REDIRECTION CHARACTERISTICS

(75) Inventors: Robert Scott Wesson, Gregory, MI (US); Monte Harry Kaehr, Ann Arbor, MI (US); Masahiro Kojima, Novi, MI (US); Rob Crawford, Belleville, MI (US); Dane Edward Feagans, Boonville, IN (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 569 days.

(21) Appl. No.: 11/345,959

(22) Filed: Feb. 2, 2006

(65) Prior Publication Data

US 2007/0182107 A1 Aug. 9, 2007

(51) Int. Cl.
*E06B 7/16* (2006.01)

(52) U.S. Cl. ..... 49/475.1; 49/502; 49/503; 277/644; 277/650

(58) Field of Classification Search ..... 49/475.1, 49/502, 503; 277/644, 650, 921; 292/336.3; 296/146.1, 180.1
See application file for complete search history.

(56) References Cited

U.S. PATENT DOCUMENTS

| | | | | |
|---|---|---|---|---|
| 2,117,192 | A | 5/1938 | McClung | |
| 3,381,988 | A | 5/1968 | Dewar | |
| 3,507,132 | A | 4/1970 | Schwenk | |
| 4,412,696 | A | 11/1983 | Ishii et al. | |
| 5,352,004 | A | 10/1994 | Nedbal | |
| 5,860,684 | A * | 1/1999 | Mizuki | 292/336.3 |
| 6,234,041 | B1 * | 5/2001 | Larabet et al. | 74/523 |
| 6,234,548 | B1 | 5/2001 | Mittelbach et al. | |
| 6,415,636 | B1 | 7/2002 | Fukumoto et al. | |
| 6,588,813 | B1 * | 7/2003 | Marcarini et al. | 292/347 |
| 6,698,262 | B2 * | 3/2004 | Wittwer | 70/208 |
| 6,802,544 | B1 * | 10/2004 | Lane | 292/336.3 |
| 6,834,901 | B2 * | 12/2004 | Low | 296/1.02 |
| 6,871,887 | B2 | 3/2005 | Jooss et al. | |
| 6,880,870 | B2 * | 4/2005 | Costigan | 292/336.3 |
| 7,029,054 | B2 * | 4/2006 | Kobayashi et al. | 296/146.1 |
| 7,331,618 | B2 * | 2/2008 | Jooss et al. | 292/336.3 |
| 2003/0038486 | A1 * | 2/2003 | Nomura et al. | 292/336.3 |
| 2004/0251709 | A1 * | 12/2004 | Kobayashi et al. | 296/146.1 |

(Continued)

FOREIGN PATENT DOCUMENTS

| | | |
|---|---|---|
| GB | 2304802 | 3/1997 |

*Primary Examiner*—Katherine W Mitchell
*Assistant Examiner*—Catherine A Kelly
(74) *Attorney, Agent, or Firm*—Gifford, Krass, Sprinkle, Anderson & Citkowski, P.C.

(57) ABSTRACT

A wind redirecting and environmentally sealing gasket for use with a handle actuating mechanism associated with a vehicle door. The gasket includes a main body located over an aperture defined perimeter in the vehicle door and which is secured by a portion of the handle mechanism. A non-linear and generally three-dimensional tongue shaped portion extends from the body at a junction defined between an extending portion of the handle and the door. The tongue portion is impinged by air flow resulting from movement of a vehicle and, as a result, is redirected about the body and away from the handle and perimeter defined aperture in the vehicle's sheet metal. An engaging portion extends separately from the tongue and contacts a perimeter defining edge location of the metal.

20 Claims, 2 Drawing Sheets

U.S. PATENT DOCUMENTS

2005/0253413 A1* 11/2005 Munezane ..... 296/146.1
2006/0038417 A1* 2/2006 Pudney ..... 292/336.3
2006/0163887 A1* 7/2006 Savant ..... 292/336.3
2007/0138811 A1* 6/2007 Lee ..... 292/336.3
2008/0036219 A1* 2/2008 Savant et al. ..... 292/336.3

* cited by examiner

OUTSIDE GASKET FOR A VEHICLE HANDLE EXHIBITING WIND REDIRECTION CHARACTERISTICS

BACKGROUND OF THE INVENTION

1. Field of the Invention

The present invention relates generally to an exterior located gasket seal for use with a vehicle. More specifically, the present invention discloses a novel gasket seal design operable to redirect air away from a gap existing between an exterior mounted door handle and the surrounding exterior sheet metal. The configuration of the seal, in particular that of its outer configured edge, provides effective environmental protection and increased dimensional tolerances between door handle and sheet metal shapes.

2. Description of the Prior Art

The prior art is well documented with examples of gasket rib or seal assemblies, such as which are utilized in an area of a vehicle exterior surface in proximity to an actuating door handle. The objective of such gasket seals is to provide an environmental seal at the exposed juncture between the exterior sheet metal and the actuating components of the door handle.

In one known application, a substantially flattened gasket seal is secured between a gap existing between an inner configured surface of a door handle assembly and an exterior surface of the vehicle sheet metal. The shortcomings associated with such reduced environmental sealing include most notably air rushing (wind) noises heard inside the vehicle.

Other examples of existing gaskets for use with a vehicle door handle include such as which is set forth in U.S. Pat. No. 5,352,004, issued to Nedbal, and which teaches a handle housing formed of a body portion and a terminal lip portion surrounding the peripheral edge of the body portion. The handle housing further includes grooves formed in the body portion adjacent the terminal lip portion. The gasket includes rib members which are dimensioned and contoured so as to tightly engage with the grooves for securely mounting the gasket to the door handle housing.

Larabet, U.S. Pat. No. 6,234,041, teaches a combined cushion and seal for a door handle assembly including, in relevant part, an annular shaped and resilient member mounted on an arm portion of a handle and proximate the arm portion and a handle grip portion. The resilient member includes a plurality of cushion portions projecting inwardly from the inner surface of the resilient member to cushion the impact of the handle with the housing as the handle moves to its closed position. The resilient member further includes an annular peripheral seal portion projecting inwardly from its inner surface, in surrounding relation to the cushion portions and movable into sealing coaction with the housing to preclude the entry of moisture and contaminants into the interior of the door with the handle in the closed position.

Finally, U.S. Pat. No. 3,381,988, issued to Dewar, teaches a sealed construction for door handles, outside mirrors and the like, and in which the seal includes a tail portion inserted into a channel formed in the outer wall of the selected mounted member. A head portion of the seal is compressed between the inner leg defining the channel and a base member. Upon deforming the tail portion within the channel, the seal is retained in the mounted member prior to assembly of the mounted member onto the base member.

SUMMARY OF THE PRESENT INVENTION

The present invention is a gasket for use with an actuating door handle assembly associated with an exterior surface location of a vehicle door. In particular, the gasket according to the present invention, in addition to sealing about an aperture formed in the door and through which the handle mechanism extends, provides the feature of wind redirection at the junction established between the inner door handle surface and the exterior contoured surface of the vehicle, this serving to eliminate wind noise which would otherwise be generated.

A main body portion of the gasket includes an inner defined template cutout, which matches the configuration of the vehicle surface metal surrounding the aperture for receiving the actuating door handle mechanism. An engaging portion of the elongated door handle secures the main body portion of the gasket in sandwiching and biasing fashion around the aperture and against the perimeter defining locations of the sheet metal surface.

The three-dimensional, non-linear tongue portion extends from the main body, at the junction between the inner surface of the elongate extending door handle and the recessed angled surface of the sheet metal. The tongue contacts the recessed sheet metal surface at one or more locations and, such that, the gap existing at that location is thereby filled or covered by the tongue portion the purpose for which again being to redirect air currents impacting the handle at the junction about the handle and sandwiched main body portion of the gasket.

An engaging portion extends from the main body independently of the non-linear tongue and engages a perimeter defining edge location of the vehicle surface. The engaging portion includes a substantially "U" shape in cross section and with a terminating and angled lip portion extending in angular fashion from a free end of the engaging portion.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
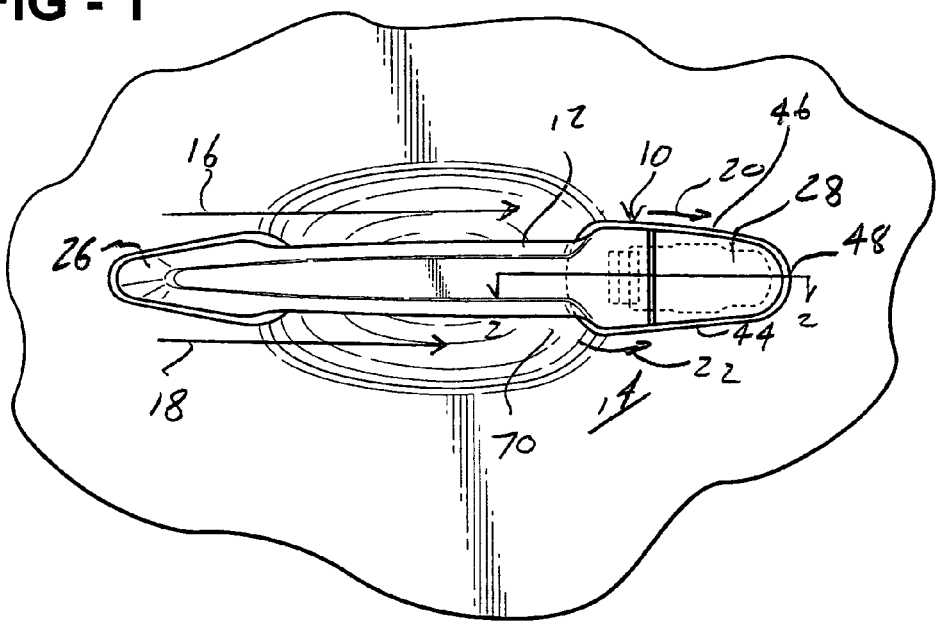
FIG. 1 is an exterior plan view of an exterior door handle assembly and exhibiting the environmentally sealing/wind noise eliminating gasket according to the present invention.
Figure 5:
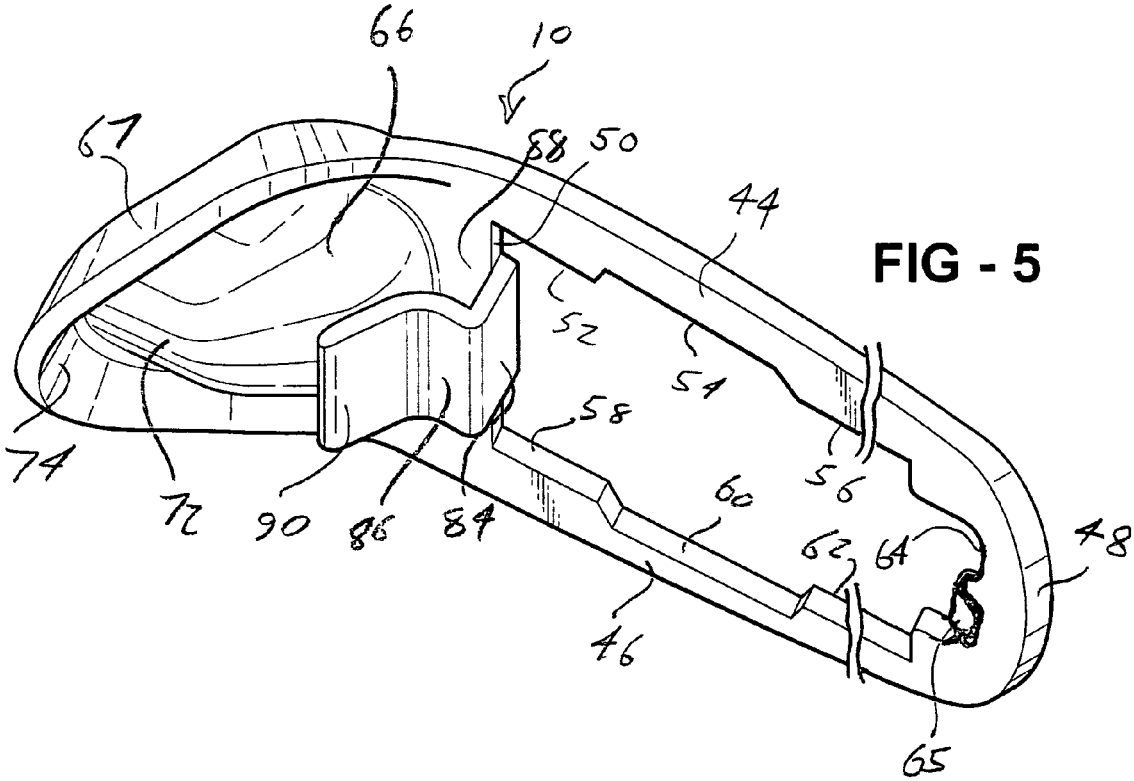
FIG. 5 is a perspective view of the three-dimensional shaped gasket according to the present invention.

Referring now to FIGS. 1 and 5, a gasket 10 is illustrated according to the present invention for securing at a junction established between an exterior actuating handle mechanism 12 and a vehicle door 14.

Figure 2:
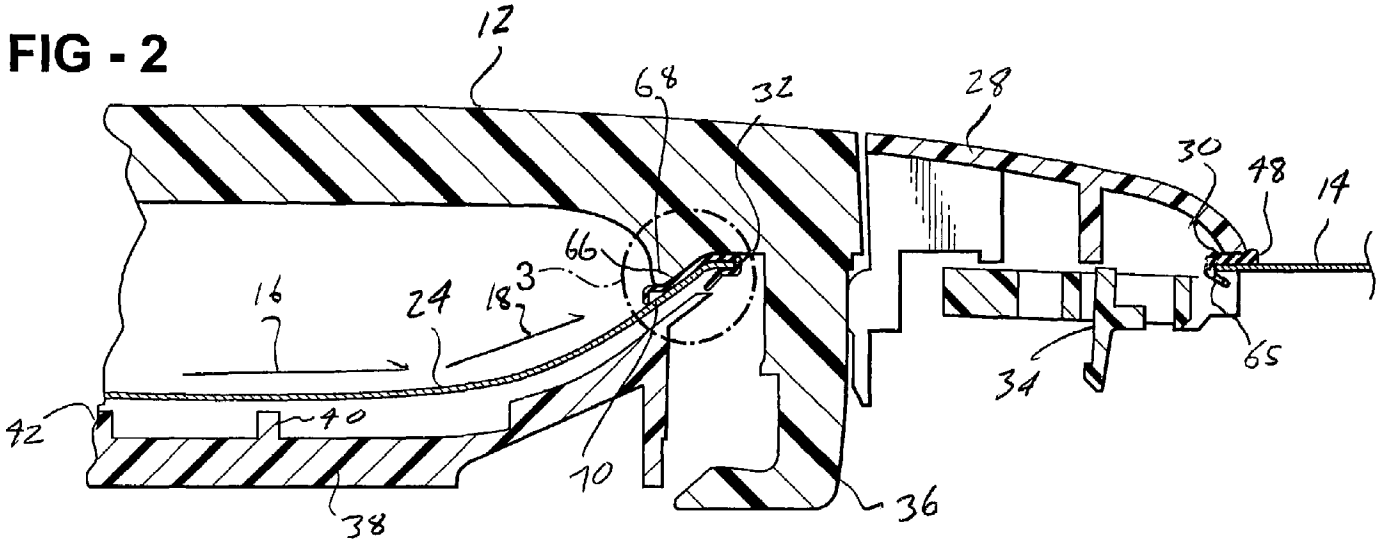
FIG. 2 is a cutaway view, taken along line 2-2 of FIG. 1, and illustrating the door handle geometry of FIG. 1 relative to the surface sheet metal of the vehicle door.

In particular, and referencing again the exterior plan and environmental view of FIG. 1 in cooperation with the cutaway view of FIG. 2, the gasket 10 is operable to redirect air currents, representatively shown at 16 and 18, about the perimeter of the gasket 10 and associated contacting portion of the handle mechanism, see further wind current representative lines 20 and 22. Absent the gasket design of the present invention, air currents impinging the inner arcuate surface at the junction established between the inner extending surface of the door handle 12 and the associated recessed area, see further at 24, would result in wind noise heard inside the vehicle.

Figure 3:
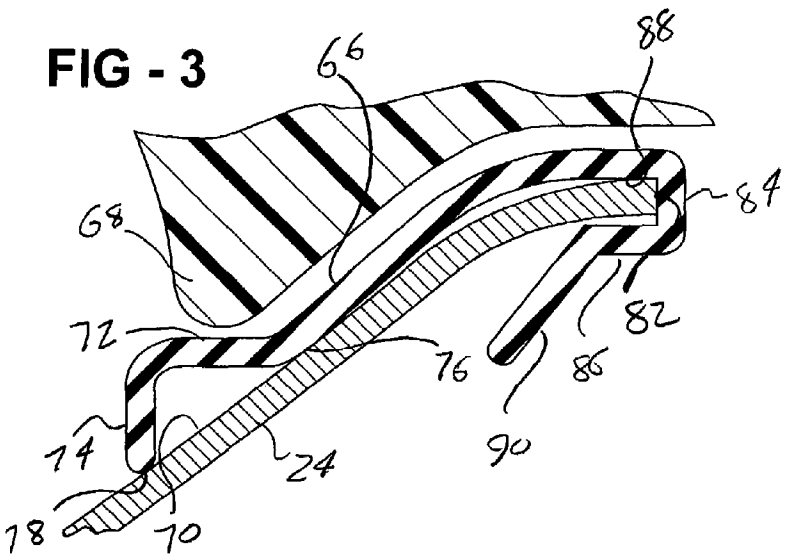
FIG. 3 is an enlarged partial view taken from FIG. 2 and illustrating the non-linear extending and surface abutting tongue and associated engaging lip edge of the gasket for eliminating wind noise through the gap existing between the inside surface of the door handle and surface sheet metal.

Referencing again FIGS. 1 and 3, the handle 12 exhibits a substantially elongated shape and which includes a first end 26 and a second end 28 securing to associated exterior surface locations of the vehicle surface 14. The first (forward) end 26 is typically fixed to the vehicle surface, whereas the second (rearward) end 28 forms a portion of a pivoting/actuating mechanism associating with the handle and which is defined in relation to an aperture, see first and second inner perimeter extending edge locations 30 and 32 in FIG. 2, through which the latch engaging structure 34 associated with the door handle extends. As further seen in FIG. 2, the handle assembly further includes additional structure located inside of the vehicle sheet metal surface 24, such as which is further illustrated by trigger portion 36 and inner extending portion 38 with support locations 40, 42, et seq., this serving to provide interconnected support along an inner surface of the sheet metal 24 and to prevent the metal from bending or buckling during actuation of the handle mechanism.

Referencing again FIG. 5, the gasket 10 is constructed of a biasing and durable material, such as a rubberized, modified plasticized or other composition, and includes a main body generally identified by substantially planar and elongate extending sides 44 and 46, rear rounded end 48 and forward edge 50. Viewing the gasket 10 in FIG. 5 in cooperation with the cutaway illustration of FIG. 2, it is evident that the overall length of the gasket sides 44 and 46 is substantially greater than that shown, and is accordingly illustrated in reduced length for purposes of ease and clarity of illustration.

Opposing and inner extending surfaces defined by the sides 44 & 46 and ends 48 & 50 establish a template cutout configuration, see as shown in FIG. 5 by interconnected surfaces 52, 54, and 56 extending along side 44 and associated interconnected surfaces 58, 60 and 62 extending along side 46. The rear rounded end 48 is further characterized by an inner arcuate edge profile 64, from which projects an angled finger portion 65 (see also FIG. 2) for grasping an associated perimeter extending edge of the vehicle surface sheet metal. The forward inner edge 50 of the gasket seal again extends in substantially linear fashion. As described previously, the main cutout template portion of the gasket 10 is secured by the (rear) latch engaging portion 28 of the door handle assembly 12, such as by being sandwiched against the vehicle surface 14 in environmentally sealing fashion.

The gasket 10 is further characterized by a substantially tongue shaped, three-dimensional and non-linear extending portion, see as represented at 66 in each of FIGS. 2, 3 and 6. As again illustrated in the cutaway of FIG. 2, when viewed in cooperation with the partial enlarged cutaway of FIG. 3, the tongue portion 66 extends integrally from the inner edge location 50 of the main body portion of the gasket 10, and in such a manner that it fills or overlays an open gap established by a junction between the inside extending surface of the outer secured door handle 12, see pinch-preventative projection 68 in each of FIGS. 2 and 3, and the recessed angling surface of the door 14, see further recessed location 70.

The specific configuration of the tongue portion 66 is open to some modification within the scope of the invention, the same understood to most broadly encompass any stepped, arcuate/spoon or other suitable shape with a number of interconnected and respective non-linear extending locations, and such as which may exhibit any configured edge profile, such as shown by outer arcuate lip or skirt profile 67 in FIG. 5. As referenced in the cutaway of FIG. 3, the tongue 66 exhibits first 72 and second 74 angled legs, these contacting the recessed vehicle surface 70 at associated first 76 and second 78 locations (see again FIG. 3).

Figure 4:
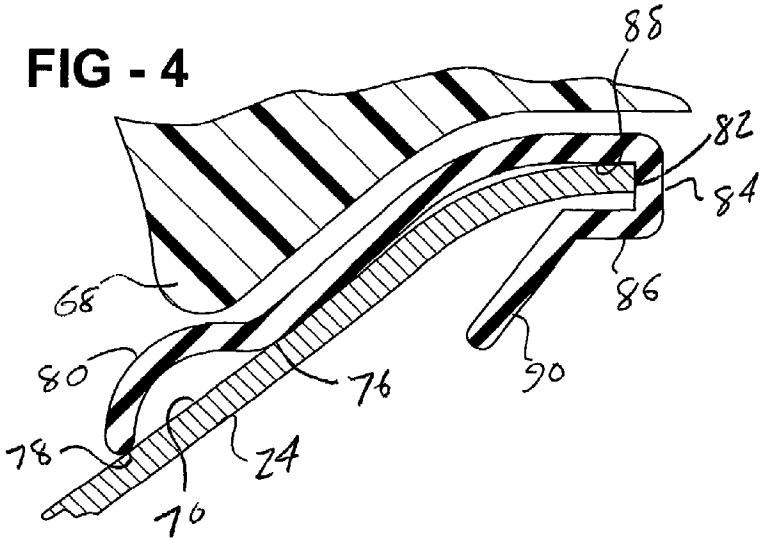
FIG. 4 is an alternate to FIG. 3 and showing a variation of the non-linear extending tongue according to the present invention.

In an alternate configuration illustrated in FIG. 4, the first and second angled legs 72 and 74 are substituted by an arcuate/spoon shaped configuration, see cutaway portion 80, and which again contacts the outer sheet metal surface 24 and the specified locations 76 and 78. It is further understood that the configuration of the tongue 66 is such that may only contact the sheet metal surface at a single, or multiple, locations, the significance again being that it is operable to redirect the impinging air current striking the inner door handle around the contacting location 24 and associated sealing main body of the gasket 10.

Extending integrally from the main body inner template edge 50 is a separate engaging portion associated with the gasket 10 and which is configured for gripping an interior and perimeter extending edge location, see at 82 in FIG. 3, of the vehicle surface aperture. The engaging portion is referenced by first substantially perpendicular leg 84 and a succeeding and likewise substantially perpendicular extending leg 86, these in cooperation with an underside surface location 88 of the gasket located proximate the template cutout defining a substantially "U" shaped profile for gripping the inner edge location 82 of the sheet metal 24 and in order to secure the gasket material supporting the tongue projecting portion 66 in its desired location within the gap defined between the door recess and the projecting handle. A further terminating and angled lip 90 is provided in extending fashion from the outermost connecting leg 86 and to prevent the engaging edge from becoming dislodged with respect to the associated edge 82 of the sheet metal surface 24 and which, in cooperation with the projecting finger 65 associated with the arcuate inner edge profile 64 of the gasket, provides secure gripping of the sheet metal ends in use.

Having described my invention, it is apparent that the gasket design of the present invention provides effective wind current redirection around and away from a gap existing between the inner door surface handle and the vehicle surface, again in order to eliminate wind noise heard within the vehicle during motion thereof. Other and additional preferred embodiments will become apparent to those skilled in the art to which it pertains, and without deviating from the scope of the appended claims.

We claim:

1. A gasket for use with an actuating exterior door handle assembly extending through an aperture defined in a vehicle surface, said gasket comprising:

a main body contacting the vehicle surface in encircling fashion about the aperture, a portion of the door handle assembly sandwiching said main body against the vehicle surface; and a tongue extending in non-linear fashion from said body and overlaying a recessed area of the vehicle surface inwardly spaced from the handle;

said tongue redirecting air flow away from a gap existing between the door handle and recessed vehicle surface, and around the handle.

2. The gasket as described in claim 1, said main body further comprising an inner template cutout configuration matching an associated configuration of the vehicle surface surrounding the aperture, a finger portion projecting from an end of said template configuration and engaging the vehicle surface opposite said tongue.

3. The gasket as described in claim 1, further comprising an engaging portion extending from said body independently of said non-linear extending tongue, said portion engaging a perimeter defining edge location of the vehicle surface.

4. The gasket as described in claim 1, said non-linear extending tongue further comprising a three-dimensional stepped profile including first and second angled legs contacting the recessed vehicle surface at first and second locations.

5. The gasket as described in claim 1, said non-linear extending tongue further comprising a three-dimensional arcuate profile contacting the recessed vehicle surface at first and second locations.

6. The gasket as described in claim 3, said engaging portion further comprising a substantially "U" shaped cross section, a terminating and angled lip portion extending in angular fashion from a free end of said engaging portion.

7. The gasket as described in claim 3, said main body, tongue and engaging portions being integrally defined in a single article having a specified shape and size and being constructed of a durable rubberized material.

8. An air redirection gasket for use with an exterior door handle assembly of a vehicle, comprising:

a three-dimensional shaped and integrally formed article constructed of a biasing and environmentally resistant material;

the door handle assembly adapted to biasingly engage a first portion of said article against a vehicle surface and in encircling fashion about an aperture formed in the surface through which the door handle engages; and a second portion of said article integrally extending from said first portion in non-uniform and three-dimensional fashion and within a recessed area defined between the vehicle surface which is inwardly spaced from the handle, air flow contacting said second portion being redirected away from the recessed area and around the handle.

9. The gasket as described in claim 8, said first portion further comprising a main body exhibiting an inner template cutout configuration matching an associated configuration of the vehicle surface surrounding the aperture, a finger portion projecting from an end of said template configuration and engaging the vehicle surface opposite said second portion.

10. The gasket as described in claim 9, said second portion further comprising a tongue shape extending in arcuate fashion from said main body and which contacts the vehicle surface at first and second locations.

11. The gasket as described in claim 10, said tongue further comprising a stepped profile including first and second angled legs.

12. The gasket as described in claim 10, said tongue further comprising an arcuate profile.

13. The gasket as described in claim 8, said article further comprising a third engaging portion extending independently of said second portion and contacting a perimeter defining edge location of the vehicle surface.

14. The gasket as described in claim 13, said third engaging portion further comprising a substantially "U" shaped cross section, a terminating and angled lip portion extending in angular fashion from a free end of said engaging portion.

15. The gasket as described in claim 14, said main body, tongue and engaging portions being integrally defined in a single article having a specified shape and size and being constructed of a durable rubberized material.

16. A wind redirecting and environmentally sealing gasket for use with a handle actuating mechanism secured to a vehicle door; comprising:

a body secured about an aperture defined perimeter in the vehicle door by a portion of the door handle; and a non-linear portion extending from said body at a junction defined between an extending portion of the handle and the door, said non-linear portion being impinged by air flow resulting from movement of a vehicle and redirecting the air flow about the body and handle secured thereupon.

17. The gasket as described in claim 16, said body further comprising an inner template cutout configuration matching an associated configuration of the vehicle surface surrounding the aperture, a finger portion projecting from an end of said template configuration and engaging the vehicle surface opposite said non-linear portion.

18. The gasket as described in claim 16, said non-linear portion further comprising a tongue shape contacting the door in spaced fashion relative to the handle.

19. The gasket as described in claim 18, said tongue exhibiting an arcuate and three-dimensional profile and covering a recessed area of the door located proximate an inner contoured surface of the handle.

20. The gasket as described in claim 18, further comprising an engaging portion extending from said body independently of said non-linear extending tongue, said portion engaging a perimeter defining edge location of the door.

* * * * *